US011547224B2

(12) United States Patent
Wootten, Jr.

(10) Patent No.: US 11,547,224 B2
(45) Date of Patent: Jan. 10, 2023

(54) COVERING HAVING A NON-SLIP ELASTIC MEMBER

(71) Applicant: HomTex, Inc., Cullman, AL (US)

(72) Inventor: Gerald E. Wootten, Jr., Cullman, AL (US)

(73) Assignee: HomTex, Inc., Cullman, AL (US)

( * ) Notice: Subject to any disclaimer, the term of this patent is extended or adjusted under 35 U.S.C. 154(b) by 316 days.

(21) Appl. No.: 16/907,142

(22) Filed: Jun. 19, 2020

(65) Prior Publication Data

US 2020/0397163 A1 Dec. 24, 2020

Related U.S. Application Data

(60) Provisional application No. 62/863,328, filed on Jun. 19, 2019.

(51) Int. Cl.
*A47G 9/04* (2006.01)
*A47G 9/02* (2006.01)

(52) U.S. Cl.
CPC ..... *A47G 9/04* (2013.01); *A47G 9/0246* (2013.01)

(58) Field of Classification Search
CPC ..... A47G 9/04; A47G 9/0246; A47C 21/026; A47C 31/105
See application file for complete search history.

(56) References Cited

U.S. PATENT DOCUMENTS 4,662,013 A * 5/1987 Harrison ..... A47C 21/022 5/497
4,720,415 A * 1/1988 Vander Wielen ..... A61F 13/15593 428/152
4,825,489 A * 5/1989 Ross ..... A47G 9/0246 5/497
4,962,546 A * 10/1990 Vitale ..... A47C 31/105 5/500

(Continued)

FOREIGN PATENT DOCUMENTS

WO 9903378 A1 1/1999

OTHER PUBLICATIONS

"International Search Report and Written Opinion for PCT Patent Application No. PCT/US2020/038834", dated Oct. 8, 2020, 7 pages.

(Continued)

*Primary Examiner* — Eric J Kurilla
(74) *Attorney, Agent, or Firm* — Lorri W. Cooper; Cooper & Maersch LLC

(57) ABSTRACT

A fitted mattress covering includes a body and an elastic strip. The body includes an upper surface and a side portion extending therefrom. The upper surface and the side portion together define a cavity therebetween shaped to receive a mattress. The side portion defines a lower edge of the body. The elastic strip is attached to the lower edge of the body and extends across and/or around a portion of the cavity. The elastic strip includes an inwardly-facing surface facing into (Continued)

the cavity and an outwardly-facing surface facing away from the cavity. At least part of one or both of the inwardly-facing surface and/or the outwardly-facing surface includes a non-slip portion. The non-slip portion is configured to generate a higher coefficient of friction with an adjacent surface than the elastic strip would provide without the non-slip portion.

20 Claims, 5 Drawing Sheets

(56) References Cited

U.S. PATENT DOCUMENTS 5,127,115 A * 7/1992 Williams ..... A47G 9/0246 112/475.08
5,165,128 A * 11/1992 Honig ..... A47G 9/0246 5/482
5,325,555 A * 7/1994 Whitley ..... A47C 31/105 5/500
5,479,664 A 1/1996 Hollander
5,513,403 A * 5/1996 Wooten, Jr. ..... A47G 9/0246 5/497
5,528,780 A 6/1996 Taylor
5,542,137 A * 8/1996 Byfield ..... A47C 31/105 5/500
5,621,931 A * 4/1997 Hamilton ..... A47G 9/0292 5/493
5,625,912 A * 5/1997 McCain ..... A47G 9/0246 5/500
5,815,861 A * 10/1998 LaGrange ..... A47C 21/022 24/72.5
5,996,148 A * 12/1999 McCain ..... A47C 31/105 5/497
6,272,701 B1 * 8/2001 Zafiroglu ..... D04B 21/202 5/497
6,353,947 B1 * 3/2002 McCain ..... A47G 9/0246 5/500
6,499,157 B1 * 12/2002 McCain ..... A47G 9/0246 5/497
6,732,389 B2 * 5/2004 Drexler ..... A47G 9/0238 5/500
6,842,921 B1 * 1/2005 Tsiarkezos ..... A47G 9/0246 5/497
7,316,039 B2 1/2008 Wootten, Jr.
D670,125 S * 11/2012 Agarwall ..... D6/602
9,167,908 B1 * 10/2015 Anthony ..... A47C 19/021
10,856,678 B2 * 12/2020 Vitale ..... A47G 9/0246
10,905,264 B1 * 2/2021 Getschow ..... A47C 31/105
11,064,825 B2 * 7/2021 Serafini ..... A47G 9/02
2004/0226089 A1 * 11/2004 Miranda ..... A47C 23/00 5/493
2006/0143826 A1 * 7/2006 Barros ..... A47G 9/0246 5/493
2008/0078029 A1 * 4/2008 Seago ..... A47G 9/0246 5/497
2012/0260424 A1 * 10/2012 Agarwall ..... A47G 9/0246 493/393
2013/0239328 A1 9/2013 Rose
2014/0007347 A1 * 1/2014 Olson ..... A47G 9/0246 5/496
2016/0066715 A1 3/2016 Hannula
2016/0073798 A1 * 3/2016 Pawlikowski ..... A47G 9/0246 297/219.1
2020/0253385 A1 * 8/2020 Parnes ..... A47C 21/02
2020/0260886 A1 * 8/2020 Chen ..... A47C 21/022
2020/0288889 A1 * 9/2020 Tak ..... A47G 9/0246
2020/0383503 A1 * 12/2020 Pesina ..... A47G 9/0246
2021/0100379 A1 * 4/2021 Pesina ..... A47G 9/0246
2021/0259440 A1 * 8/2021 Pizzurro ..... A47G 9/0246
2021/0274951 A1 * 9/2021 Sadar ..... A47G 9/04

OTHER PUBLICATIONS

PCT/US2020/038834, International Preliminary Report on Patentability, dated Dec. 21, 2021, 5 pages.

* cited by examiner

COVERING HAVING A NON-SLIP ELASTIC MEMBER

CROSS-REFERENCE TO RELATED APPLICATION

This application claims priority to U.S. Provisional Patent Application No. 62/863,328, filed Jun. 19, 2019, the disclosure of which is incorporated herein by reference in its entirety.

FIELD

The technology described herein relates to a bed covering having an elastic member that provides non-slip properties.

BACKGROUND

In the art, there presently exists a variety of known fitted sheets for mattresses and the like. Such sheets typically employ an elastic binding at or around the lower edge of the sheets to gather the lower edge and to permit a user to stretch the lower edge of the sheet to fit around and/or under a mattress. Elastic bindings typically extend around the entire free edge or perimeter of the sheet and are used to help to retain the fitted sheet on the mattress. Alternatively, elastic bindings can be positioned at the corners of the periphery of the sheet opening, at the ends of the sheet opening, along the sides of the sheet opening, a combination thereof, or other locations as known by those of skill in the art.

For certain sheet designs, additional widthwise or diagonally extending elastic straps or panels may be provided at the corners of the sheet or elsewhere thereon. Elastic straps are bands that are typically positioned across the corners of the opening of the sheet and have a width like a standard strip of elastic. Some sheets use panels of elastic material instead of or in conjunction with straps. The elastic panels can extend across the corners of the opening of the sheet or along an entire end of the opening of the sheet, among other known locations, so that the elastic straps and/or panels extend under the mattress when properly installed thereon. The elastic bindings, in conjunction with the elastic straps and panels, facilitate fitting of the sheet on mattresses of different sizes, and further eliminate wrinkles in the fitted sheet.

Although the elastic binding and elastic straps/panels may provide adequate retention on a mattress, one drawback of existing designs is that the straps or panels can slide with respect to the mattress because both the elastic member and the mattress have fiber surfaces. Therefore, it is advantageous to design an elastic member that can engage in slip-resistant contact with the mattress and/or another surface, such as the box spring, platform bed, or the floor.

BRIEF DESCRIPTION OF THE DRAWING FIGURES

DETAILED DESCRIPTION

Figure 1:
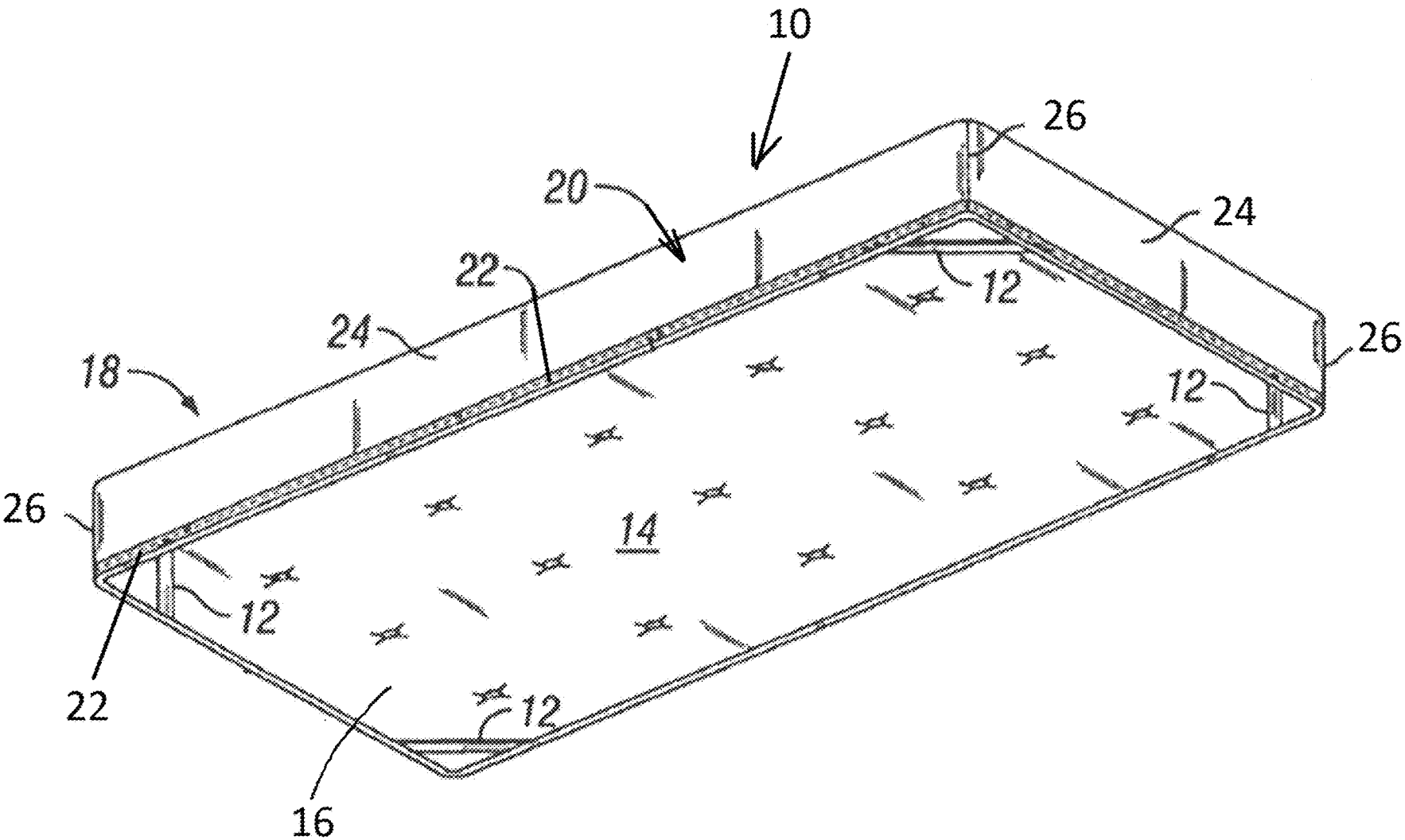
FIG. 1 depicts a bottom perspective view of a mattress having a fitted covering with an exemplary elastic binding or strap according to the present invention mounted thereon.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Moreover, the term "or" is intended to mean an inclusive "or" rather than an exclusive "or." In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something and is not intended to indicate a preference.

Elastic is known to be installed on fitted sheets or fitted bed coverings 10. In the presently described invention, the elastic is installed on the fitted sheet 10 so that it extends outwardly away from the underlying mattress 14 and/or inwardly towards the underlying mattress 14. Elastic is typically provided in strips or panels. Strips may have any number of widths, such as ½", 1",1½" and other sizes. Panels may be any size and may be any type of stretchy fabric, such as cotton, polyester, cotton/polyester blends, nylon, and the like. Panels may also be thick strips of elastic.

Elastic is a notion that is sold in strips or cords and that generally serves to increase the ability of an article to stretch. Elastic comes in four forms of construction. The component of elastic that performs the actual stretching is made of either rubber or a synthetic material, such as spandex. The stretching component, e.g., rubber strand, is then covered with polyester, cotton, nylon, or a combination of these or other fibers that allow it to be attached to an article. High quality elastic can be stretched up to twice its original length and then return to its unflexed state without showing appreciable wear.

Elastic can be braided, knitted, woven, or transparent. Braided elastic is the most common form of elastic and becomes narrower as it stretches. This type of elastic has distinct parallel ribs along its surface and is often used for hems. Stitching or piercing this type of elastic causes it to lose its ability to return to its original shape. Knitted elastic is considered soft, lightweight, and strong. It does not narrow when stretched or pierced and is typically used for lightweight fabrics. Woven elastic is very strong and is thicker than other types of elastic. It is used for upholstery and car covers, for example. It has both crosswise and lengthwise ribs. It does not narrow when stretched or pierced. Transparent elastic is transparent polyurethane and is not braided, knitted, or woven. It can stretch to three or four times its original length with complete recovery to its former shape.

The rubber used in elastic is made of latex and may or may not include rubber as an ingredient. The most common elastics are made with latex-based rubber and polyester fibers, which are known to hold up well when worn or washed regularly. Elastics made with cotton tend to shrink slightly after being worn and washed but are versatile. Elastics can be formed as strips or can be woven into a fabric along with other materials.

Referring to the Figures, as shown in FIG. 1, an embodiment of a fitted covering 10 including one or more elastic strips 12 that are mounted on a conventional rectangular mattress 14 having a bottom face 16 and an opposite upper face or surface 18 (not visible). Fitted covering 10 generally comprises a body 20 formed of any suitable fabric such as cotton, a cotton blend, polyester, polyester blend, satin, and/or the like. The body 20 includes the upper surface 18 and at least one side portion 24 extending from the upper surface 18 to define a cavity therebetween that receives the mattress 14. The at least one side portion 24 includes a lower edge that defines an edge of the fitted covering 10. The lower edge may continuously extend around the edge of the fitted covering 10 and/or any portion(s) thereof.

The upper surface 18 may comprise any suitable shape to cover the upper face 18 of the mattress 14. The fitted covering 10 may include any number of side portions 24 and the number of side portions 24 may depend on the shape of the upper surface 18 and/or the shape of the mattress 14. For example, as illustrated in FIG. 1, the upper surface 18 may be substantially rectangular and may be sized to cover the entire upper surface 18 of the mattress 14.

The illustrated fitted covering 10 includes four side portions 24 that each extend from one edge of the rectangular upper surface 18. Part of each of the side portions 24 may be joined to an adjacent side portion 24 such that with the upper surface 18 a cavity is formed that is configured to receive the mattress 14. The side portions 24 may be joined in any suitable manner, such as sewn together to form a corner seam. In the illustrated embodiment, this results in four seams that form four vertical corners 26. The side portions 24 may have any desired length, including a length that is longer than the length of the side walls of the mattress so that part of the side portions 24 extend under the mattress 14 when the covering 10 is installed on a mattress 14. The fitted covering 14 typically will be formed of a single sheet of material or could be formed as multiple sheets of material that are sewn together.

An elastic band 22 is shown attached to the fitted covering 10 at the periphery/lower edge 18 of the opening of the fitted covering 10 to assist in retaining the fitted covering 10 on the mattress 14. The elastic band 22 can be sewn to the lower edge/periphery or could be otherwise applied, as known by those of skill in the art. The elastic band 22 can extend across an open side of the fitted covering 10 such that when the fitted covering 10 is attached to the mattress 14, the upper surface 18 extends over the top face of the mattress 14 and the elastic band 22 extends along a corresponding portion of the bottom surface 16 of the mattress 14. The use of an elastic band 22 with a conventional fitted covering 10 can more readily retain the fitted covering 10 on a mattress 14.

Figure 2:
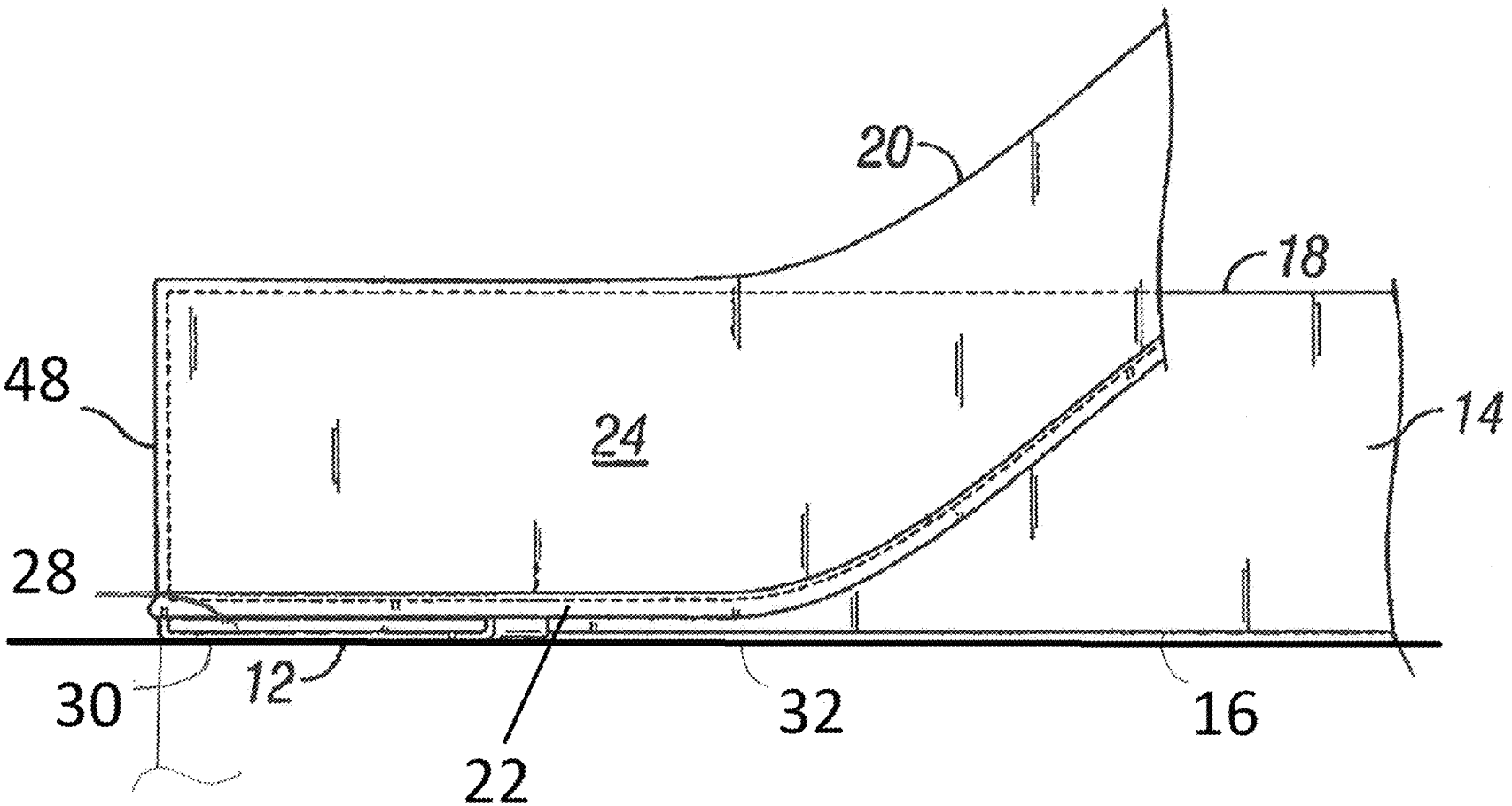
FIG. 2 depicts a side or end view illustrating a corner of the exemplary covering mounted on a mattress.

As shown in FIGS. 1 and 2, an elastic strap 12 can be utilized along with an elastic band 22. The elastic strap 12 is shown attached to two adjacent side portions 24 of the sheet and extends across the corner of the sheet between the adjacent side portions 24. The elastic strap can be sewn to the side portions. In another example, illustrated in FIG. 3, an elastic band 22 is disposed along the lower edge of the fitted covering 10 without the use of elastic straps 12. While not shown, an elastic strap 12 can extend across the width or length of the sheet 10 and multiple elastic straps 12 of this nature may be utilized, if desired.

Figure 3:
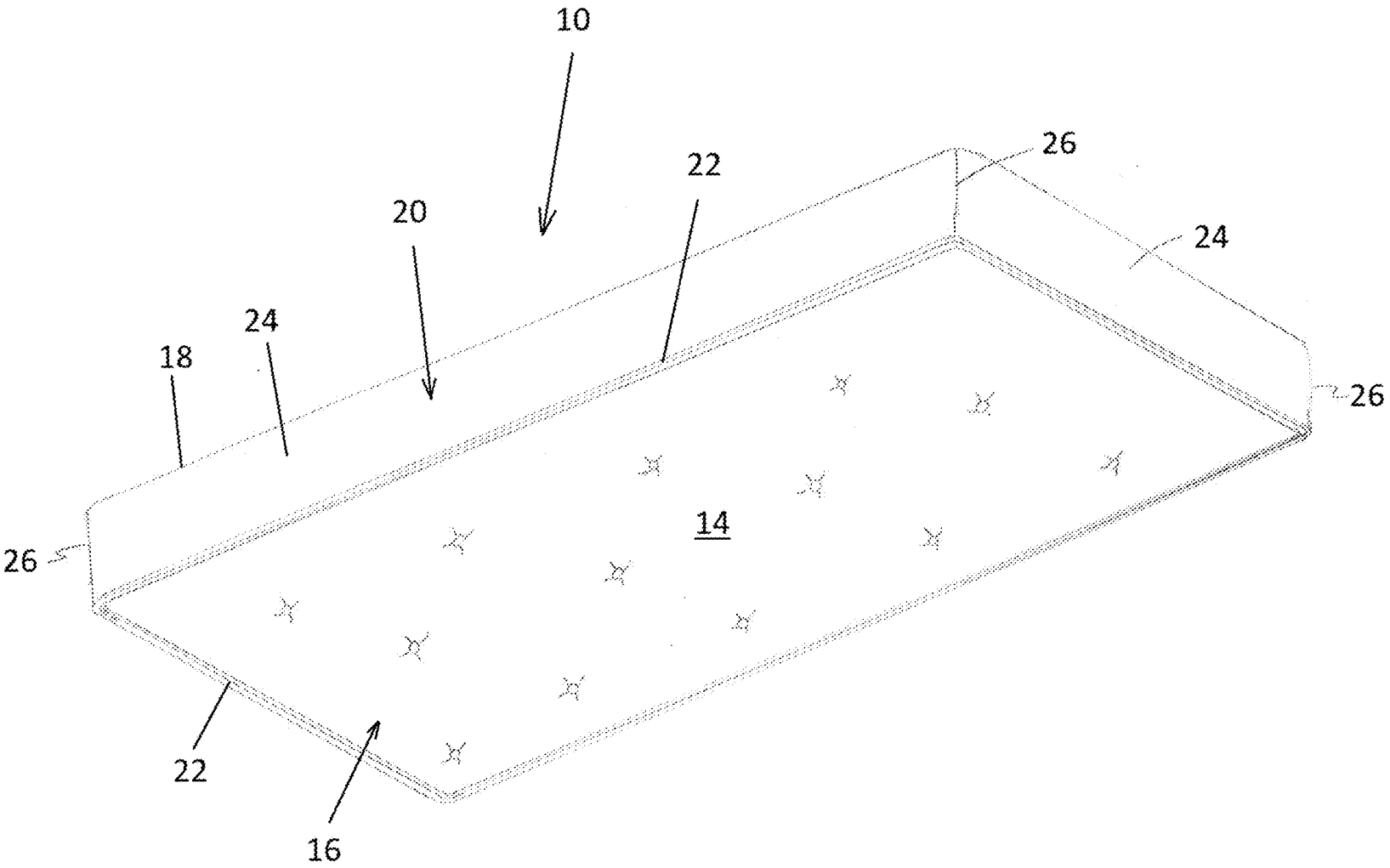
FIG. 3 depicts a bottom perspective view of a mattress having a fitted covering with another exemplary elastic binding according to the present invention mounted thereon.
Figure 7:
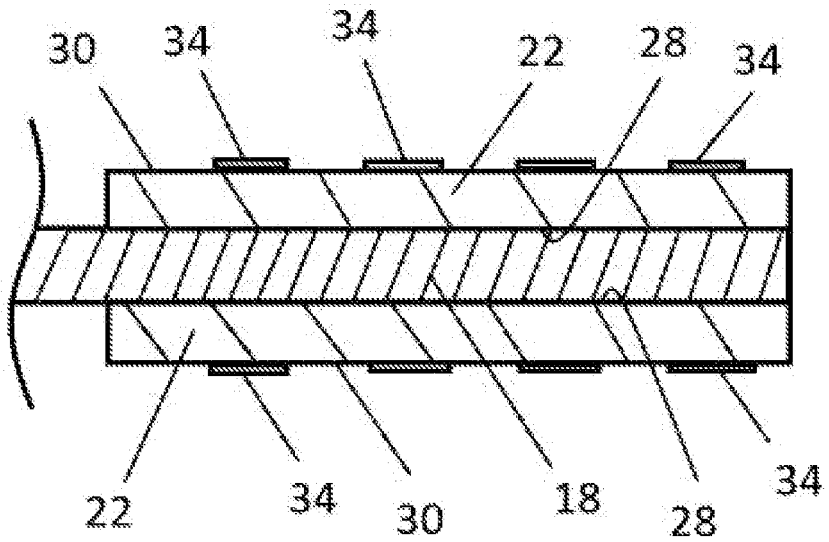
FIG. 7 depicts a cross-sectional view of one embodiment of the elastic edge of the fitted covering that has separate inner and outer bands of elastic positioned at the lower edge of the fitted covering.
Figure 8:
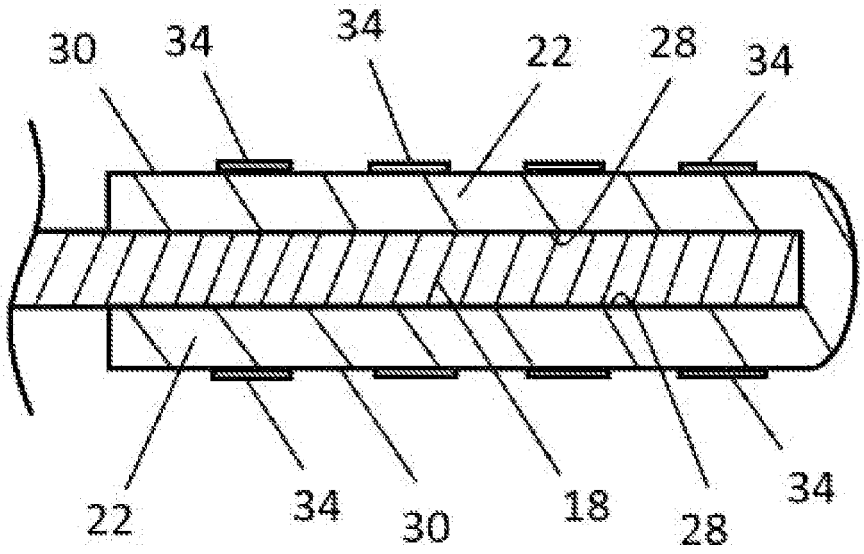
FIG. 8 depicts a cross-sectional view of another embodiment of the elastic edge of the fitted covering that has a folded over elastic band positioned at the lower edge of the fitted covering."

In FIG. 3, the elastic band 22 can be folded over itself to be attached to the lower edge 18 of the sheet 10 to provide additional stability around the lower edge 18. Alternatively, the elastic band 22 can be sewn to the exterior of the side portions 24 or the interior of the side portions 24. Two separate elastic bands, shown in FIG. 7, can be substituted for a single elastic band 22 that wraps around the edge of the lower edge 18, shown in FIG. 8. Where two separate elastic bands are used, one band is positioned on an interior surface and the other is positioned on an exterior surface around the lower edge 18. The elastic band 22 can be folded over to form a U-shape, with part of the strap being attached to an inner surface of the side portion 24 and part of the band being attached to an exterior side of the side portion 24.

The fitted covering 10 can include any number of elastic straps 12 or bands 22. For instance, as illustrated in FIG. 1, the fitted covering 10 includes four elastic straps 12 with one located adjacent each of the four corner seams of the covering 26.

The elastic straps 12 shown in FIGS. 1 and 2 can be attached to the fitted covering 10 via any satisfactory or known manner. For instance, the elastic strap 12 can be sewn onto the lower edge of a side portion 24. In another example, the elastic strap 12 can be attached via the methods described in U.S. Pat. No. 7,316,039 (incorporated herein by reference).

The elastic strap 12 is made of any suitable material for elastically stretching. For instance, the elastic strap 12 can be formed by weaving rubber to form the band, as described above. The elastic strap 12 can also include a fabric material sleeve that surrounds the rubber and forms an exterior surface of the elastic strap 12.

As illustrated in FIG. 2, the mattress 14 (with or without a fitted covering 10 described above attached) may be placed on another underlying surface 32, e.g., a face of a box spring, a bed frame, a floor surface, and/or the like. The non-slip portion of the invention is provided by the elastic straps 12 and elastic bands 22. Elastic strap 12 and elastic band 22 can include an inwardly-facing surface 28 that faces into the cavity of the fitted covering 10 and an outwardly-facing surface 30 that faces away from the cavity. When the fitted covering 10 is placed around the mattress 14, the inwardly-facing surface 28 is in contact with the mattress 14. When the fitted covering 10 is positioned around the mattress 14, the outwardly-facing surface 30 of the elastic strap 12 may be in contact with the underlying surface 32.

To help retain the elastic band 22 and elastic strap 12 in contact with the underlying surface 32, the elastic band 12 include a non-slip portion 34 that is an additive to the elastic strip or that is formed as an integral part of the elastic strip. The additive is a non-slip material, such a rubber or silicon, and the like, to generate a higher coefficient of friction between the surface and the non-slip portion 34 than would be generated without the non-slip portion. Essentially, this non-slip portion 34 can grip the surface it contacts. The non-slip portion 34 can be located at any suitable location on the elastic strap 12 or elastic band. For instance, the non-slip portion 34 can be located on the inwardly-facing surface 28 to grip the bottom face 16 of the mattress 14 and/or can be located on the outwardly-facing surface 30 to grip the underlying surface 32. By gripping the bottom face 16 of the mattress 14, the non-slip portion 34 of the elastic strap 12 or band 22 can help limit movement of the fitted covering 10 relative to the mattress 14. The elastic band 22/strap 12 can assist in retaining the covering 10 on the mattress 14.

The non-slip portion 34 can be a coating that is applied to one or both sides of the elastic strip. The coating can cover the entire surface or can be selectively applied. When selectively applied, the coating can cover part or all of the surface area of the elastic strip. The coating can extend along the entire length of the elastic strip or only part of the length of the elastic strip. The coating can have different thicknesses or the same thickness on the elastic strip.

Multiple elastic strips may form the binding around the lower edge. Or a single elastic strip may form the binding around the lower edge. When only part of the lower edge is covered by the elastic strip, multiple elastic strips may be used. The non-slip portion does not have to be consistent on all the elastic strips. It can vary.

In another example, the non-slip portion 34 can be located solely on the outwardly-facing surface 30 to grip the underlying surface 32. In yet another example, the inwardly-facing surface 28 and the outwardly facing surface 30 can both include non-slip portions such that the elastic strap 12 grips both the bottom face 16 of the mattress 14 and the underlying surface 32. By gripping both the mattress 14 and the underlying surface 32 at the same time, a non-slip elastic strap 12 can also be used to help limit movement of the mattress 14 relative to the underlying surface 32.

The elastic band 22 can include a non-slip portion 34 positioned on one side of the elastic band 22. The elastic band 22 of this embodiment is folded over the lower edge so that the non-slip portion faces both inwardly and outwardly.

Figure 4:
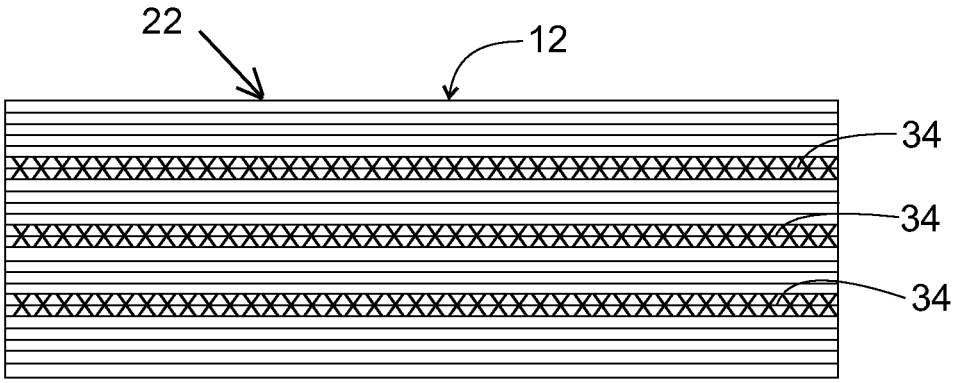
FIG. 4 depicts an exemplary elastic strip that includes a non-slip portion that is sewn into/integral with the elastic.
Figure 5:
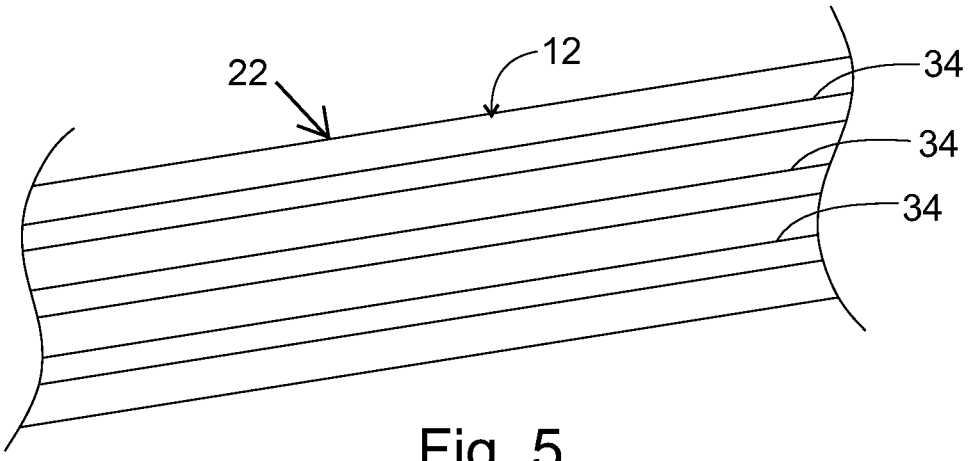
FIG. 5 depicts another exemplary elastic strip that includes a non-slip portion adhered to the elastic.
Figure 6:
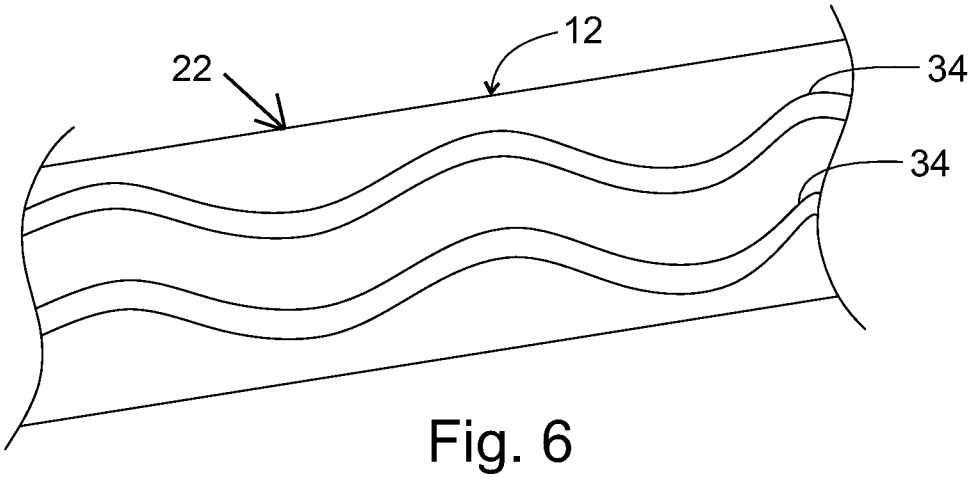
FIG. 6 depicts yet another exemplary elastic strip that includes a non-slip portion adhered to the elastic strip in a pattern that is different from that shown in FIG. 5.

Any suitable method may be used to form the non-slip portion 34. To provide the non-slip portion 34, the elastic strip may have exposed rubber threads, as shown in FIG. 4, where the rubber threads are not covered with a fabric or other material. The remainder of the elastic strip has rubber threads that are covered with a fabric or other material so that they are not non-slip portions. Rubber naturally has non-slip characteristics. The exposed rubber portions can be on one side or both the front and rear sides of the elastic strip, including both sides thereof. The exposed elastic can be formed in patterns on the elastic strip, such as in lines along the length of the elastic, or other patterns along the length of the elastic. FIG. 5 depicts straight lines of non-slip material extending along the length of the elastic strip and FIG. 6 depicts wavy lines of non-slip material extending along the length of the elastic strip. If desired an entire surface of the elastic can be exposed rubber. Alternatively, only parts of the elastic strip may include exposed rubber. The elastic strip can be woven to elevate the exposed rubber portions above the fabric covered portions of the strip.

Alternatively, a non-slip material can be adhered or otherwise applied to the outer surface or surfaces of the elastic strip to provide a non-slip surface. For example, a silicone material can be deposited or otherwise adhered to the elastic strip on one or both sides thereof. As shown in FIGS. 5 and 6, the silicone can be provided in a pattern on the elastic strip, such as straight lines, wavy lines, or other patterns. The non-slip portion 34 can be further configured to elastically stretch with the elastic strap 12 or band 22 when the strip stretches to prevent deformation of the non-slip portion 34 and to permit the elastic strip to return to its original shape. The non-slip portion 34 could also be sewn on or heated onto the elastic strip.

The non-slip portion 34 can take any suitable shape for gripping the external surface. For instance, as illustrated in FIGS. 4 and 5, the non-slip portion 34 can comprise one or more parallel straight lines each of a specific width that extend along a length of the elastic strap 12. In another example, illustrated in FIG. 6, the non-slip portion 34 can comprise one or more curved lines that extend along a length of the elastic strap 12.

Where both the inwardly-facing surface 28 and the outwardly-facing surface 30 of the elastic strap 12 have a non-slip portion 34, the non-slip portions 34 on each side of the elastic strap 12 can be placed symmetrically and/or placement can vary. For instance, the non-slip portion 34 on the outwardly-facing surface 30 can be offset from non-slip portion 34 on the inwardly-facing surface 28. Further, the shape of the non-slip portion 34 can be similar when both the inwardly-facing surface 28 and the outwardly-facing surface 30 include a non-slip portion 34 and/or the shape can be varied. In one embodiment, the non-slip portion 34 on the inwardly-facing surface 28 can comprise one or more straight lines while the non-slip portion 34 on the outwardly-facing surface 30 can comprise one or more curved lines. Alternatively, the number of lines or the amount of non-slip material positioned on the elastic strip can be different between the inwardly-facing 28 and outwardly-facing 30 surfaces.

Both FIGS. 1 and 3 show an elastic binding around the lower edge. The non-slip portion 34 can be provided on both the inwardly-facing 28 or the outwardly-facing 30 surfaces. The binding may be provided around the entire opening while only part of the binding has the non-slip material. For example, the non-slip material could be provided only in the corner areas, only along the top and bottom ends, only along the sides, or a combination thereof. It is not required that all the elastic strips have a non-slip portion.

The width of the various strips of elastic can vary. A different width of elastic strip can be used for the corner straps 12 from the elastic band 22. Different widths of elastic can be used for the binding 22, if desired. For example, thicker elastic could be used along the ends of the opening and thinner elastic strips could be used along the sides of the opening. Even the corner straps 12 could have different widths, if desired.

The outer facing surface of the elastic strap can have non-slip portions, as described above, so that when the elastic strap is disposed around the opening of the bed covering, the non-slip portions are exposed both upwardly and downwardly. This embodiment may be used in conjunction with the corner straps, or alone, without the corner straps. The non-slip portions around the opening help to retain the sheet on the mattress by engaging the under-side of the mattress. In addition, the non-slip portions help to deter slippage or sliding of the mattress/bed covering on the underlying surface.

While not shown, elastic could be positioned only at the corner straps and not around the opening. Non-slip portions could be positioned on the elastic straps 12, but not on the elastic bands 22.

While not depicted, the above-noted cover can be used to cover other items, such as chair covers, seat covers, or the like.

A fitted mattress covering includes a body and an elastic strip. The body includes an upper surface and a side portion extending therefrom. The upper surface and the side portion together define a cavity therebetween shaped to receive a mattress. The side portion defines a lower edge of the body. The elastic strip is attached to the lower edge of the body and extends across and/or around a portion of the cavity. The elastic strip includes an inwardly-facing surface facing into the cavity and an outwardly-facing surface facing away from the cavity. At least part of one or both of the inwardly-facing surface and/or the outwardly-facing surface includes a non-slip portion. The non-slip portion is configured to generate a higher coefficient of friction with an adjacent surface than the elastic strip would provide without the non-slip portion.

While not depicted, the above-noted cover can be used to cover other items, such as chair covers, seat covers, or the like.

The elastic strip may include one or more of an elastic strap that extends across part of the cavity or an elastic band that is coupled to the lower edge of the body. The upper surface may include a rectangular shape. A plurality of side portions may extend from the upper surface to define the cavity for receiving a mattress. Two side portions of the plurality of side portions may be joined to form a corner seam. The elastic strip may be a strap that is coupled at one end to a first side portion and at the other end to a second side portion, with the first and second side portions being positioned adjacent one another, and the strap spans a corner of the mattress covering. The elastic strip may include an elastic band that is positioned at the lower edge of the mattress covering.

The elastic band may be positioned on both an interior side of the lower edge and an exterior side of the lower edge. The elastic band may include two elastic bands, with one being positioned solely on the interior side of the lower edge and one being positioned solely on the exterior side of the lower edge. The elastic band may be folded over the lower edge.

The elastic strip may include a plurality of elastic straps and at least one elastic band, with the elastic straps being positioned at corners of the covering and the elastic band extending around at least part of the periphery of the lower edge. The elastic band may extend around the entire periphery of the lower edge.

The non-slip portion may be adhered, deposited on, or applied to the elastic strip. The non-slip portion may be a silicone coating. The non-slip portion may be an exposed rubber portion of the elastic strip. The non-slip portion may be applied to an inner side and an outer side of the lower edge. The non-slip portion may be applied to one of a front or a back surface of the elastic strip, the elastic strip is an elastic band, the elastic band is folded over at least part of the lower edge, and the non-slip portion faces outwardly.

The body may be fabric or other materials, if desired. The fabrics could be woven or non-woven.

The non-slip portion may include silicone or a non-slip material that is attached or formed as part of a surface of the elastic strip. The non-slip portion may be formed in a pattern on the surface of the elastic strip. The pattern may include one or more longitudinal lines, a coating that covers the entire surface of the elastic strip, or a coating that covers part of the surface of the elastic strip. The non-slip portion may be formed as an integral part of the elastic strip and may include exposed rubber.

What has been described above includes examples of one or more embodiments. The above-described embodiments may be used singly or in combination. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fitted mattress covering comprising:

a body comprising an upper surface and a side portion extending therefrom, wherein the upper surface and the side portion define a cavity therebetween shaped to receive a mattress, with the side portion defining a lower edge of the body; and an elastic strip attached to the lower edge of the body and extending across and/or around a portion of the cavity, wherein the elastic strip includes an inwardly-facing surface facing into the cavity and an outwardly-facing surface facing away from the cavity, wherein at least part of one or both of the inwardly-facing surface and/or the outwardly-facing surface includes a non-slip portion, wherein the non-slip portion is configured to generate a higher coefficient of friction with an adjacent surface than the elastic strip would provide without the non-slip portion, and wherein the non-slip portion is only associated with the elastic strip and not the body.

2. The covering of claim 1, wherein the elastic strip comprises one or more of an elastic strap that extends across part of the cavity or an elastic band that is coupled to the lower edge of the body.

3. The covering of claim 1, wherein the upper surface comprises a rectangular shape and a plurality of side portions extend from the upper surface to define the cavity for receiving a mattress.

4. The covering of claim 3, wherein two side portions of the plurality of side portions are joined to form a corner seam and the elastic strip is a strap that is coupled at one end to a first side portion and at the other end to a second side portion, with the first and second side portions being positioned adjacent one another, and the strap spans a corner of the mattress covering.

5. The covering of claim 1, wherein the elastic strip comprises an elastic band that is positioned at the lower edge of the mattress covering.

6. The covering of claim 5, wherein the elastic band is positioned on both an interior side of the lower edge and an exterior side of the lower edge.

7. The covering of claim 6, wherein the elastic band is folded over the lower edge.

8. The covering of claim 1, wherein the elastic strip comprises a plurality of elastic straps and at least one elastic band, with the elastic straps being positioned at corners of the covering and the elastic band extending around at least part of the periphery of the lower edge.

9. The covering of claim 8, wherein the elastic band extends around the entire periphery of the lower edge.

10. The covering of claim 1, wherein the non-slip portion is adhered, deposited on, or applied to the elastic strip.

11. The covering of claim 1, wherein the non-slip portion is a silicone coating.

12. The covering of claim 1, wherein the non-slip portion is an exposed rubber portion of the elastic strip.

13. The covering of claim 1, wherein the non-slip portion is applied to an inner side and an outer side of the lower edge.

14. The covering of claim 1, wherein the body is fabric.

15. The covering of claim 1, wherein the non-slip portion comprises silicone or a non-slip material that is attached or formed as part of a surface of the elastic strip.

16. The covering of claim 15, wherein the non-slip portion is formed in a pattern on the surface of the elastic strip.

17. The covering of claim 16, wherein the pattern comprises one or more longitudinal lines, a coating that covers the entire surface of the elastic strip, or a coating that covers part of the surface of the elastic strip.

18. The covering of claim 15, wherein the non-slip portion is formed as an integral part of the elastic strip and comprises exposed rubber.

19. A fitted mattress covering comprising:

a body comprising an upper surface and a side portion extending therefrom, wherein the upper surface and the side portion define a cavity therebetween shaped to receive a mattress, with the side portion defining a lower edge of the body; and an elastic strip attached to the lower edge of the body and extending across and/or around a portion of the cavity, wherein the elastic strip includes an inwardly-facing surface facing into the cavity and an outwardly-facing surface facing away from the cavity, wherein at least part of one or both of the inwardly-facing surface and/or the outwardly-facing surface includes a non-slip portion, wherein the non-slip portion is configured to generate a higher coefficient of friction with an adjacent surface than the elastic strip would provide without the non-slip portion, wherein the elastic strip comprises an elastic band that is positioned at the lower edge of the mattress covering on both an interior side of the lower edge and an exterior side of the lower edge, and the elastic band comprises two elastic bands, with one being positioned solely on the interior side of the lower edge and one being positioned solely on the exterior side of the lower edge.

20. A fitted mattress covering comprising:

a body comprising an upper surface and a side portion extending therefrom, wherein the upper surface and the side portion define a cavity therebetween shaped to receive a mattress, with the side portion defining a lower edge of the body; and an elastic strip attached to the lower edge of the body and extending across and/or around a portion of the cavity, wherein the elastic strip includes an inwardly-facing surface facing into the cavity and an outwardly-facing surface facing away from the cavity, wherein at least part of one or both of the inwardly-facing surface and/or the outwardly-facing surface includes a non-slip portion, wherein the non-slip portion is configured to generate a higher coefficient of friction with an adjacent surface than the elastic strip would provide without the non-slip portion, wherein the non-slip portion is applied to one of a front or a back surface of the elastic strip, the elastic strip is an elastic band, the elastic band is folded over at least part of the lower edge, and the non-slip portion faces outwardly.

* * * * *